US010557432B2

(12) United States Patent
Dian et al.

(10) Patent No.: US 10,557,432 B2
(45) Date of Patent: Feb. 11, 2020

(54) FUEL INJECTION SYSTEMS

(71) Applicant: Continental Automotive GmbH, Hannover (DE)

(72) Inventors: Vincent Dian, Manching (DE); Matthias Scheid, Regensburg (DE)

(73) Assignee: CONTINENTAL AUTOMOTIVE GMBH, Hannover (DE)

( * ) Notice: Subject to any disclaimer, the term of this patent is extended or adjusted under 35 U.S.C. 154(b) by 0 days.

(21) Appl. No.: 16/092,791

(22) PCT Filed: Feb. 22, 2017

(86) PCT No.: PCT/EP2017/054055
§ 371 (c)(1),
(2) Date: Oct. 11, 2018

(87) PCT Pub. No.: WO2017/178140
PCT Pub. Date: Oct. 19, 2017

(65) Prior Publication Data

US 2019/0120156 A1 Apr. 25, 2019

(30) Foreign Application Priority Data

Apr. 15, 2016 (DE) ..... 10 2016 206 369

(51) Int. Cl.
*F02D 41/20* (2006.01)
*F02M 51/06* (2006.01)
*F02D 41/24* (2006.01)

(52) U.S. Cl.
CPC ..... *F02D 41/2096* (2013.01); *F02D 41/2467* (2013.01); *F02M 51/0603* (2013.01);
(Continued)

(58) Field of Classification Search
CPC .. F02D 41/20; F02D 41/2096; F02D 41/2467; F02D 2041/2051; F02D 2041/2055; F02M 51/0603
See application file for complete search history.

(56) References Cited

U.S. PATENT DOCUMENTS

2013/0257439 A1 10/2013 Rodriguez-Amaya et al. ..... 324/415
2015/0013647 A1 1/2015 Zhang et al. ..... 123/478
(Continued)

FOREIGN PATENT DOCUMENTS

DE 10 2006 003 861 A1 8/2007 ..... F02D 41/20
DE 10 2010 063 681 A1 5/2012 ..... F02D 41/20
(Continued)

OTHER PUBLICATIONS

DE 10 2012 204 272 A1, US 2015/0013647 A1.
(Continued)

*Primary Examiner* — Hieu T Vo
(74) *Attorney, Agent, or Firm* — Slayden Grubert Beard PLLC

(57) ABSTRACT

Various embodiments include a method for operating an internal combustion engine with a fuel injection system including a piezo actuator comprising: stopping the discharge phase of the actuator during an injection cycle; measuring a voltage profile at the actuator; comparing a feedback signal at the actuator with a setpoint value; varying the discharge time of the actuator in successive injection cycles until the feedback signal corresponds to the setpoint value; defining a servo valve closing time as a defined offset with respect to the optimized discharge time; and using the defined servo valve closing time to set an injection quantity of fuel for future injection cycles.

4 Claims, 3 Drawing Sheets

(52) U.S. Cl.
CPC ..... *F02D 2041/2051* (2013.01); *F02D 2041/2055* (2013.01)

(56) References Cited

U.S. PATENT DOCUMENTS

| | | | | |
|---|---|---|---|---|
| 2016/0053704 | A1 | 2/2016 | Russe et al. | 123/478 |
| 2016/0298563 | A1 | 10/2016 | Zhang | 123/490 |

FOREIGN PATENT DOCUMENTS

| | | | | |
|---|---|---|---|---|
| DE | 10 2011 078 159 | A1 | 1/2013 | F02M 51/06 |
| DE | 10 2012 204 272 | A1 | 9/2013 | F02D 41/20 |
| DE | 10 2013 206 600 | A1 | 10/2014 | F02D 41/30 |
| DE | 10 2013 223 764 | B3 | 2/2015 | F02D 41/20 |
| EP | 1 400 675 | A1 | 3/2004 | F02D 41/20 |
| WO | 2010/023041 | A1 | 3/2010 | F02D 41/20 |
| WO | 2017/178140 | A1 | 10/2017 | F02D 41/20 |

OTHER PUBLICATIONS

DE 10 2010 063 681 A1, US 2013/0257439 A1.
DE 10 2013 223 764 B3, US 2016/0298563 A1.
DE 10 2013 206 600 A1, US 2016/0053704 A1.
German Office Action, Application No. 10 2016 206 369.3, 5 pages, dated Dec. 2, 2016.
International Search Report and Written Opinion, Application No. PCT/EP2017/054055, 21 pages, dated May 9, 2017.

FUEL INJECTION SYSTEMS

CROSS-REFERENCE TO RELATED APPLICATIONS

This application is a U.S. National Stage Application of International Application No. PCT/EP2017/054055 filed Feb. 22, 2017, which designates the United States of America, and claims priority to DE Application No. 10 2016 206 369.3 filed Apr. 15, 2016, the contents of which are hereby incorporated by reference in their entirety.

TECHNICAL FIELD

The present disclosure relates to fuel injection systems. Various embodiments may include methods for ascertaining the servo valve closing time in piezo-driven injectors and/or to fuel injection systems in which such a method is used.

BACKGROUND

Typical fuel injection systems include at least one piezo injector, e.g., a piezo diesel injector. Such a piezo injector may include a piezo actuator which activates a closure element of the injector in an indirect way, e.g. via a servo valve. In such an injector with a servo valve, the injected quantity of fuel is defined essentially by the opening period of the servo valve. In this context, the opening time of the servo valve is measured on the basis of an electric feedback signal of the piezo actuator which acts as a sensor. However, with this method it is not possible to measure the closing time of the servo valve, since in this context the amplitude of the force acting on the piezo actuator is too low. As result, in this context there is still uncertainty with respect to the opening period of the servo valve.

It is known to estimate the closing time of the servo valve on the basis of three items of information:

- the servo valve opening time,
- the electrical energy applied to the piezo actuator, since this energy correlates with the change in shape of the piezo actuator, and
- the discharge time.

However, this estimation method is influenced by various interference factors and is relatively inaccurate. For example, accuracy of +/−5 μs is not typically achieved (a typical value of the required accuracy of the injection quantity).

SUMMARY

The teachings of the present disclosure may be used to implement a method which permits particularly accurate setting of the injected quantity of fuel. Some embodiments may include: carrying out an injection process and stopping the discharge phase of a piezo actuator; using the piezo actuator as a sensor and detecting the voltage profile at the piezo actuator; evaluating the voltage rise after the end of the discharge phase by comparing the corresponding feedback signal at the piezo actuator with a setpoint value; varying the discharge time of the piezo actuator until the feedback signal corresponds to the setpoint value, in order to obtain an optimized discharge time; and defining the servo valve closing time as a defined offset with respect to the optimized discharge time.

As an example, some embodiments include a method for ascertaining the servo valve closing time in piezo-driven injectors, comprising the following steps:

(1) carrying out an injection process and stopping the discharge phase of a piezo actuator;
(2) using the piezo actuator as a sensor and detecting the voltage profile at the piezo actuator;
(3) evaluating the voltage rise after the end of the discharge phase by comparing the corresponding feedback signal at the piezo actuator with a setpoint value;
(4) varying the discharge time of the piezo actuator until the feedback signal corresponds to the setpoint value, in order to obtain an optimized discharge time; and
(5) defining the servo valve closing time as a defined offset with respect to the optimized discharge time.

In some embodiments, the amplitude of the voltage rise at the piezo actuator is measured as a voltage rise.

In some embodiments, said method is carried out during the driving operation of a vehicle having a piezo-driven injector.

As another example, some embodiments include a fuel injection system having at least one piezo-driven injector and a control unit, characterized in that the control unit is designed to carry out the method as described above.

In some embodiments, the servo valve closing time which is ascertained by the control unit is used thereby to set the injected quantity of fuel.

BRIEF DESCRIPTION OF THE DRAWINGS

The teaching are further explained in detail below with reference to an exemplary embodiment in connection with the drawing. In the drawings.

DETAILED DESCRIPTION

Figure 1:
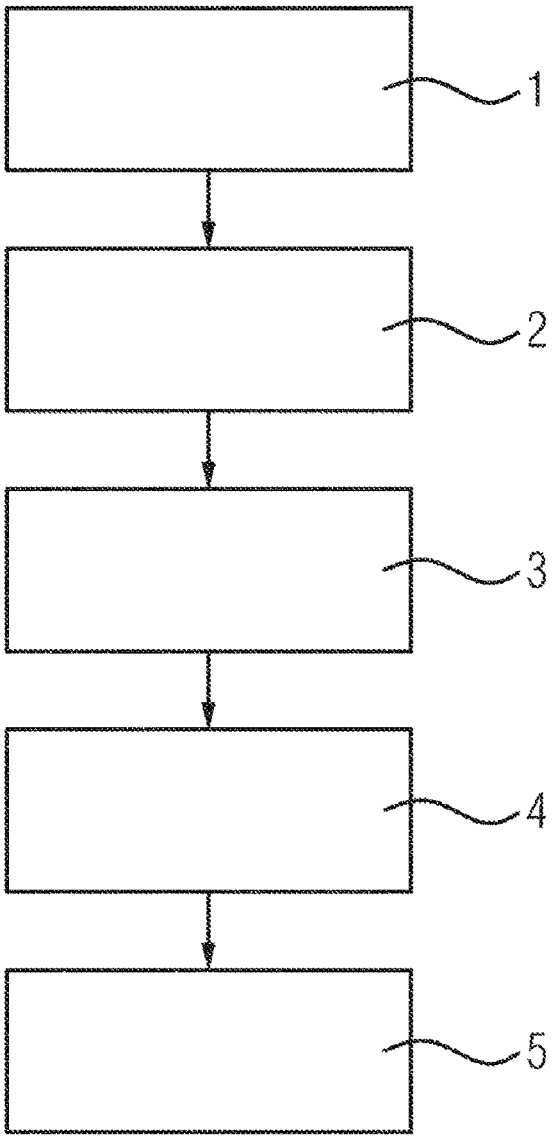
FIG. 1 shows a flowchart of the individual steps of a method incorporating teachings of the present disclosure.

In a servo-operated injector there is a mechanical or hydraulic connection between the actuator and the servo valve. In the case of a piezo actuator, the latter can be used as a sensor for measuring the pressure profile in the valve space, e.g. during the closing phase of the servo valve. During this phase, the pressure in the servo valve space rises from approximately 5 to 10% of the rail pressure up to the rail pressure.

In order to measure this rise in pressure accurately, in the example method incorporating teachings of the present disclosure, the discharge phase is stopped and the voltage profile measured at the piezo actuator is acquired. Since the piezo actuator must primarily close the servo valve, the corresponding discharge time of the piezo actuator must be long enough to close the servo valve. On the other hand, the discharge time must be short enough to allow at least part of the rise in pressure to be measured. The correct discharge time is now ascertained.

In the case of a short discharge time, the signal quality is good, but the risk of a delay in the closing of the servo valve owing to an excessively short discharge time is high. On the other hand, in the case of a long discharge time the signal quality is poor. In some embodiments, to ascertain the suitable discharge time, the voltage rise at the piezo actuator is evaluated after the end of the discharge. In this context, the corresponding feedback signal is compared with a setpoint value, and the discharge time is changed until the feedback signal corresponds to the setpoint value. An optimized discharge time is then obtained.

The servo valve closing time is then defined as a defined offset with respect to the optimized discharge time. The servo valve closing time which is then ascertained can then be used to set the injected quantity of fuel, with the result that the accuracy with respect to the injected quantity of fuel can be improved. In some embodiments, the amplitude of the voltage rise at the piezo actuator may be measured as a voltage rise.

In some embodiments, the methods described may be carried out during the driving operation of a vehicle having a piezo injector, in particular piezo diesel injector. An on-board detection of the servo valve closing time therefore takes place. This on-board measurement is used to adapt the control of the injector, in order to reduce the tolerances of the injected quantity of fuel.

The teachings of the present disclosure may be applied to a fuel injection system having at least one piezo-driven injector and a control unit. In this context, specifically the servo valve closing time which is ascertained by the control unit is used thereby to set the injected quantity of fuel.

The exemplary embodiment described here relates to a fuel injection system of a vehicle which is provided with at least one piezo diesel injector and a control unit. The corresponding piezo diesel injector has a piezo actuator which activates a servo valve which serves to open and close a nozzle needle. The method described here involves ascertaining the servo valve closing time of the piezo diesel injector.

In step 1 of the method, in this context a customary injection process with a subsequent discharge phase of the piezo actuator for closing the servo valve is carried out, wherein the discharge phase is stopped. According to step 2, the piezo actuator is used as a sensor and the voltage profile at the piezo actuator is acquired after the end of the discharge phase.

According to step 3, the corresponding voltage rise is evaluated after the end of the discharge phase in that the corresponding feedback signal at the piezo actuator is compared with a setpoint value. Finally, in step 4 the discharge time of the piezo actuator is varied until the feedback signal corresponds to the setpoint value, in order in this way to obtain an optimized discharge time. In step 5, the servo valve closing time is defined as a defined offset with respect to the optimized discharge time.

Figure 2:
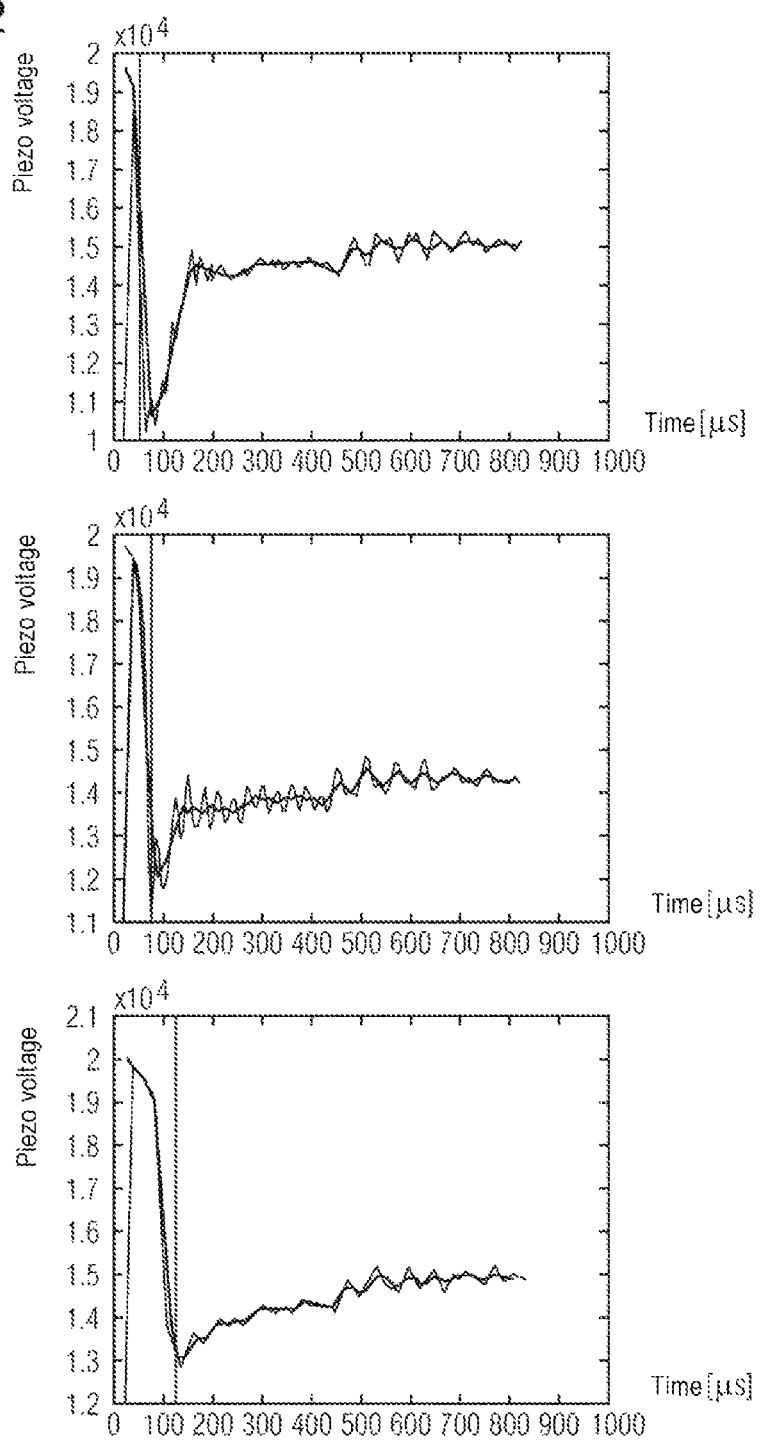
FIG. 2 shows three diagrams which show the dependence of the piezo-voltage on different discharge times according to teachings of the present disclosure.

The method is therefore concerned with ascertaining the optimized discharge time. In FIG. 2, three diagrams are illustrated which each illustrate the dependence of the piezo-voltage on the time, specifically in the case of a short discharge time in the left-hand diagram, in the case of an optimized discharge time in the middle diagram, and in the case of a long discharge time in the right-hand diagram (in each case for the raw signal and the filtered signal). In this context it is apparent that in the case of the short discharge time in the left-hand diagram of FIG. 2 a rather long and strong voltage rise occurs directly after the end of the discharge process. In the middle diagram (optimized discharge time) a voltage rise occurs directly after the end of the discharge process. In the right-hand diagram, virtually no voltage rise can be detected (only a small voltage rise owing to creeping current effects).

In the case of the short discharge time, a good signal quality is present but the risk of a delay during the servo valve closing process is high. In the case of the long discharge time, the signal quality is poor. An optimum signal quality is obtained with the middle diagram.

Figure 3:
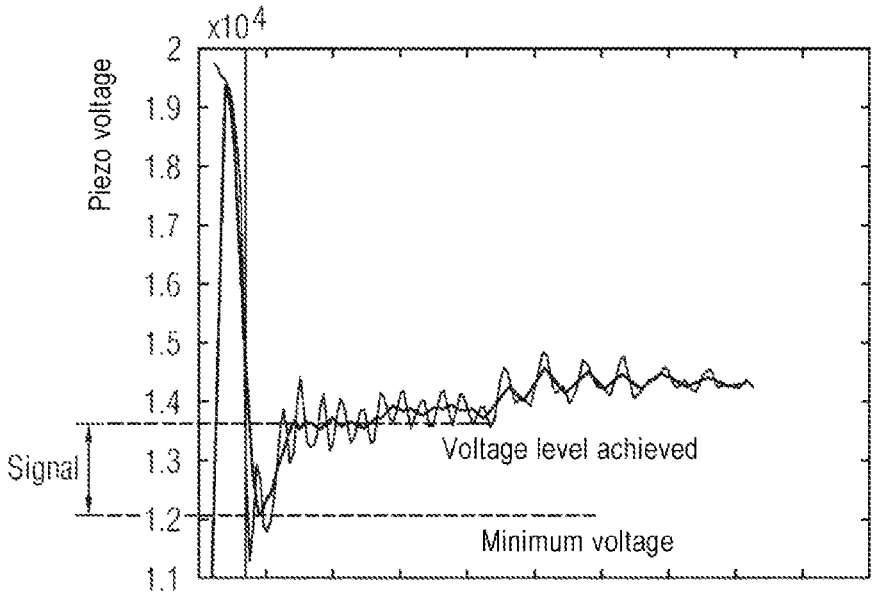
FIG. 3 shows a diagram which shows the piezo voltage during the optimized discharge time incorporating teachings of the present disclosure.

FIG. 3 shows a diagram which corresponds essentially to the middle diagram of FIG. 2 and represents the optimum discharge time (raw signal and filtered signal).

Figure 4:
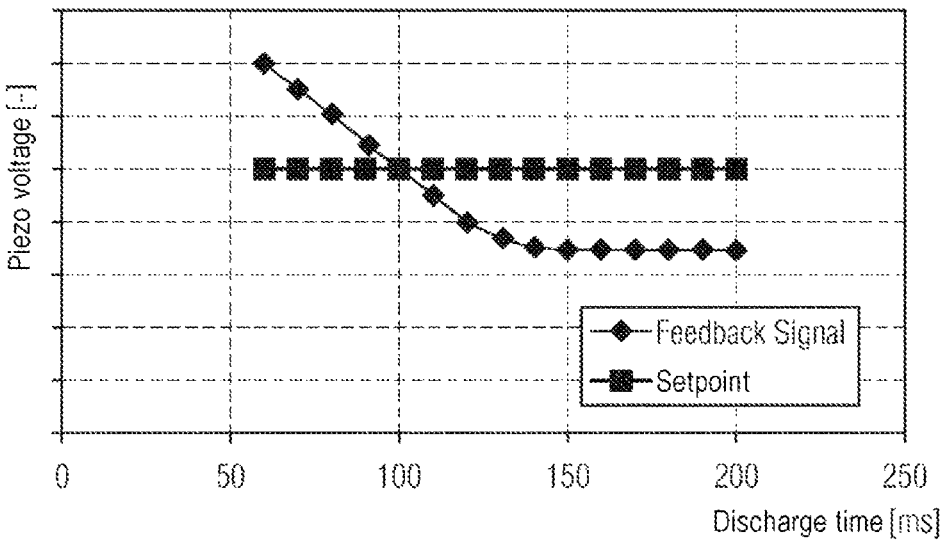
FIG. 4 shows a diagram which shows the feedback signal as a function of the discharge time incorporating teachings of the present disclosure.

FIG. 4 shows the dependence of the feedback signal on the discharge time in conjunction with the corresponding optimum.

What is claimed is:

1. A method for operating an internal combustion engine with a fuel injection system including a piezo actuator, the method comprising:

carrying out an injection process and stopping the discharge phase of the piezo actuator;

measuring a voltage profile at the piezo actuator;

evaluating the voltage profile to detect a voltage rise after the end of the discharge phase by comparing a feedback signal at the piezo actuator with a setpoint value;

varying the discharge time of the piezo actuator in successive injection cycles until the feedback signal corresponds to the setpoint value to obtain an optimized discharge time;

defining a servo valve closing time as a defined offset with respect to the optimized discharge time; and using the defined servo valve closing time to set an injection quantity of fuel for future injection cycles.

2. The method as claimed in claim 1, wherein an amplitude of the voltage rise at the piezo actuator is measured as a voltage rise.

3. The method as claimed in claim 1, wherein the said method is carried out during the driving operation of a vehicle having a piezo-driven fuel injector.

4. A fuel injection system comprising:

a piezo-driven injector injecting fuel into combustion chamber; and a control unit programmed to:

carry out an injection process and stopping the discharge phase of the piezo actuator;

measure a voltage profile at the piezo actuator;

evaluate the voltage profile to detect a voltage rise after the end of the discharge phase by comparing a feedback signal at the piezo actuator with a setpoint value;

vary the discharge time of the piezo actuator in successive injection cycles until the feedback signal corresponds to the setpoint value to obtain an optimized discharge time;

define a servo valve closing time as a defined offset with respect to the optimized discharge time; and use the defined servo valve closing time to set an injection quantity of fuel for future injection cycles.

* * * * *